United States Patent [19]

Orth

[11] 4,116,001

[45] Sep. 26, 1978

[54] SIMPLIFIED LOAD SENSITIVE HYDRAULIC SYSTEM FOR USE WITH A VEHICLE STEERING SYSTEM

[75] Inventor: Harold R. Orth, Hinsdale, Ill.

[73] Assignee: International Harvester Company, Chicago, Ill.

[21] Appl. No.: 820,518

[22] Filed: Aug. 1, 1977

[51] Int. Cl.[2] ..... F15B 11/20

[52] U.S. Cl. ..... 60/420; 60/422; 60/459; 60/484

[58] Field of Search ..... 60/420, 422, 426, 427, 60/445, 459, 484, 494; 91/412; 137/100, 101, 109

[56] References Cited

U.S. PATENT DOCUMENTS

| | | | |
|---|---|---|---|
| 3,750,405 | 8/1973 | Lech et al. | 60/427 X |
| 3,979,908 | 9/1976 | Alderson | 60/422 |
| 4,034,563 | 7/1977 | Orth | 60/422 |

*Primary Examiner*—Edgar W. Geoghegan
*Attorney, Agent, or Firm*—Douglas W. Rudy; Ronald C. Kamp; F. David AuBuchon

[57] ABSTRACT

A simple load sensitive hydraulic system having a variable displacement pump, a priority dependent work circuit, at least one secondary work circuit, priority means preferencing fluid flow to the priority dependent work circuit over the secondary work circuit, flow and pressure compensating means responsive to requirements of either work circuit for controlling displacement of the variable displacement pump and a relief valve which when overridden allows fluid flow to the secondary work circuit.

3 Claims, 3 Drawing Figures

SIMPLIFIED LOAD SENSITIVE HYDRAULIC SYSTEM FOR USE WITH A VEHICLE STEERING SYSTEM

BACKGROUND OF THE INVENTION

This invention relates to the use of a variable displacement hydraulic pump in a load sensitive hydraulic system. The hydraulic system will utilize a variable displacement hydraulic pump to supply fluid to a priority dependent work circuit and to at least one other secondary hydraulic work circuit. Priority means are incorporated to assure that the priority dependent work circuit will be supplied with required fluid at the necessary volume and pressure before the secondary work circuit requirement is fulfilled.

This invention is an improvement over prior developments in load sensitive hydraulic circuitry making these prior embodiments more adaptable to applications having utility in many fields. A recent patent (U.S. Pat. No. 4,034,563 to H. R. Orth) provided the basic system of load sensitive hydraulic circuitry of which this system is an improvement to. Also a prior patent (U.S. Pat. No. 3,750,405 to R. J. Lech, et al, Aug. 7, 1973), assigned to the same assignee as the instant invention and herein incorporated by reference, discloses the type of hydraulic system that would be subject to improvement through the utilization of the instant invention. Also, an article appearing in the September, 1975 issue of "Automotive Engineering" magazine entitled "Load-Sensitive Hydrostatic Steering—A New Approach" based on S.A.E. paper 750806 by J. L. Rau shows the state of the art using the apparatus set forth in the above mentioned Lech patent.

The instant invention is an improvement to the state of the art, including the recent patent to H. R. Orth, yielding a result that makes load sensitive steering, as well as other priority dependent systems useful, simple, and workable in actual applications by overcoming deficiencies in the contemporary art.

One feature not alleviated in the the Lech patent or the periodical article is a tendency of the primary or priority dependent circuit to recoil or kickback when a secondary work circuit is opened while high pressure is needed in the primary or priority dependent circuit. This has been one factor deleterious to the wide spread use of load sensitive priority circuits. This problem has been remedied through the provisions of the device set forth in the mentioned Orth patent.

The instant invention is a refinement of the Orth patent that has been engineered to prevent the undesirable kickback features through the use of a simpler valve system not incorporating the isolator valve of the Orth patent.

A typical application of this simplified load sensitive system is in farm tractors where a single pump may be utilized to provide fluid to such devices as, but not limited to, a steering unit, a brake unit, a hydraulic hitch as well as secondary circuits for other hydraulic devices such as implement motors, fan drive motors and bucket actuating motors (cylinders), as well as other secondary hydraulic systems and apparatus. The vehicle control devices generally must have priority of hydraulic fluid allocation for safety reasons. Often the fluid power required by primary circuits is of variable flow rates at various pressures while still having priority over the secondary circuits.

The use of the variable displacement load sensitive system is desirable as this system provides fluid at demanded rates without the waste of power not needed by the operating hydraulic systems.

SUMMARY OF THE INVENTION

This invention comprises a load sensitive hydraulic system using a variable displacement pump, two or more hydraulic circuits and appropriate controls therein to insure that the power developed and the fluid delivered by the variable displacement pump is equivalent to the power requirements of the hydraulic system and not in excess thereof. At least one hydraulic circuit is a priority dependent (or primary) circuit while the other circuits may be secondary circuits receiving fluid only when the needs of the primary circuit are fulfilled. Also, the primary and secondary circuit have flow and pressure controls for insuring that the variable displacement pump generates sufficient fluid to match the requirements of both the primary and secondary hydraulic circuits. Most important to this disclosure is the utilization of fluid pressure being relieved from a pressure relief valve to feed into the secondary work circuit rather than to the usual reservoir.

It is among the advantages of the instant invention to provide a load sensitive hydraulic fluid circuit that can control and equalize the fluid required and delivered to a plurality of work circuits including a priority dependent circuit and secondary circuits without generating undesirable kickback or recoil forces in a priority dependent circuit when a secondary circuit is opened.

A further object of this invention is to provide a load sensitive circuit that minimizes power loss, heat generation and hydraulic fluid depletion during operation of the priority dependent circuit.

Another object of this invention is to minimize the number of components necessary to optimize performance.

Also an object of this invention is to eliminate the need for extremely close tolerance machining and component sizing as is the case with state of the art devices.

DESCRIPTION OF THE DRAWINGS

The instant invention will be appreciated by a perusal of the following specification and claims when related to the accompanying drawings in which:

DETAILED DESCRIPTION OF THE DRAWINGS

Figures 1, 1B:
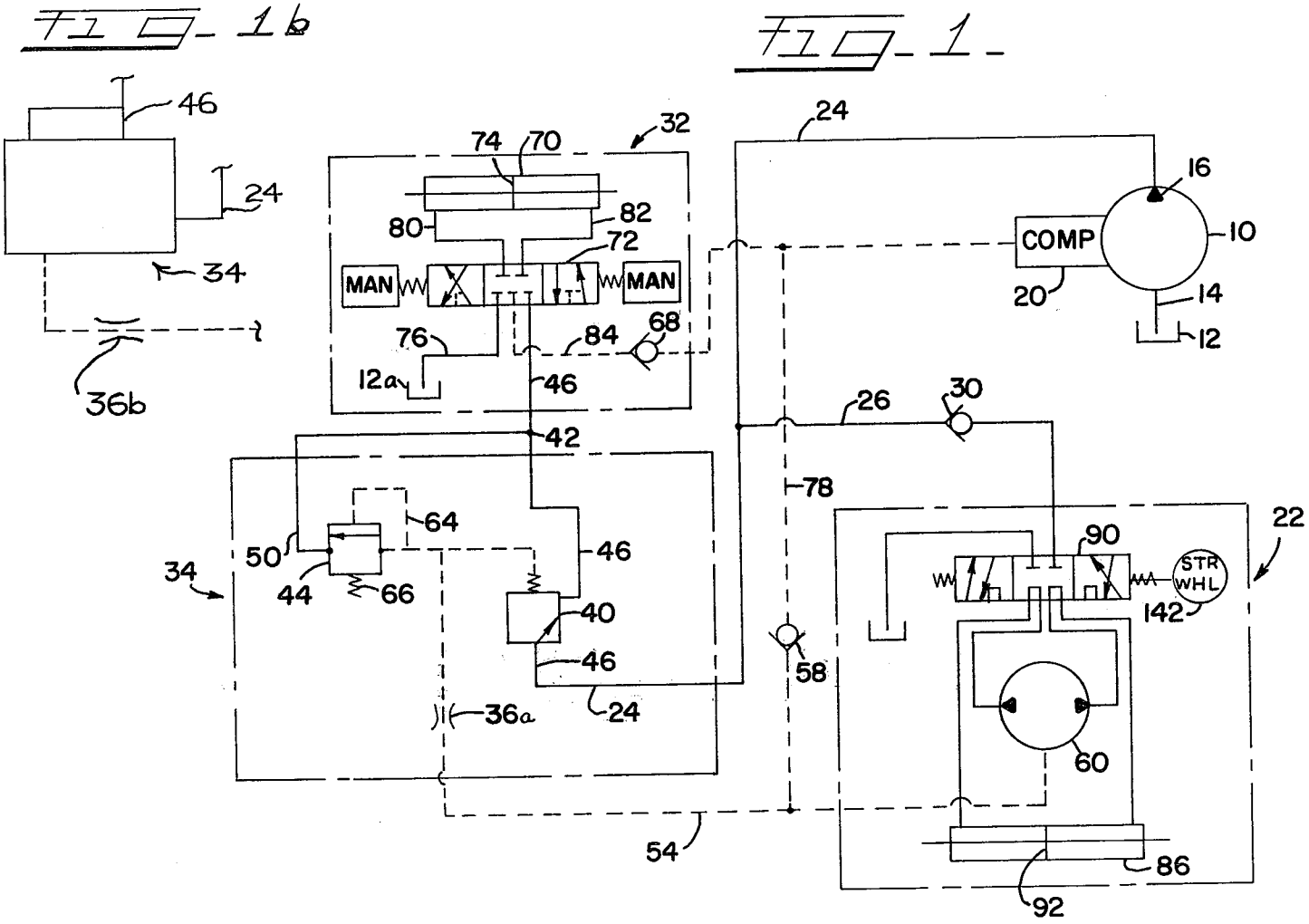
FIG. 1 is a standard graphical presentation of the load sensitive hydraulic circuit of this invention.
FIG. 1*b* shows an alternative embodiment.
Figure 2:
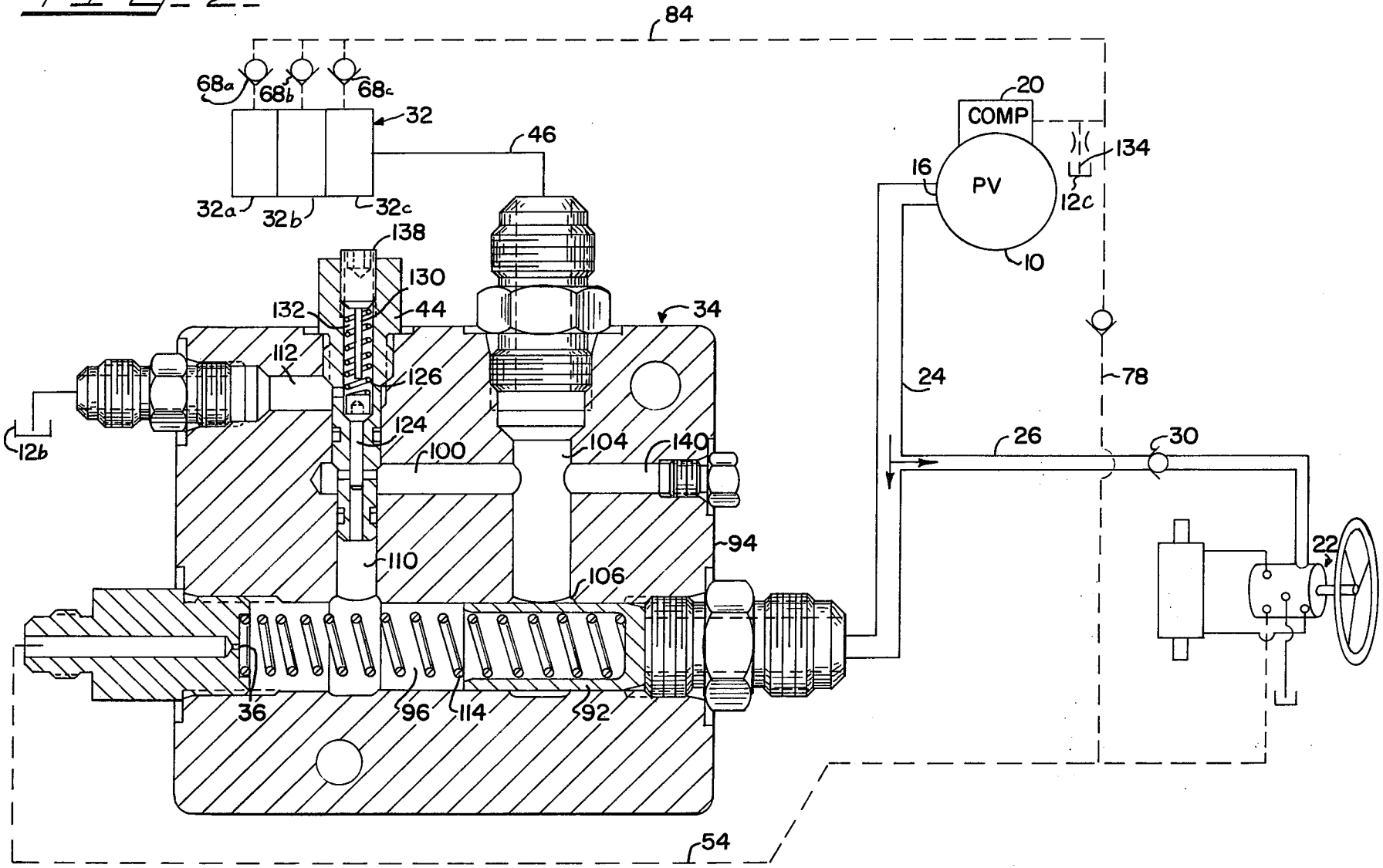
FIG. 2 is a combination diagram showing the hydraulic circuit in cutaway and graphical representations.

FIGS. 1 and 2 present the identical invention, however, FIG. 2 more clearly shows the actual configuration of several of the components. In both figures like reference characters represent like parts.

In FIG. 1 the load sensitive hydraulic circuit depends on the variable displacement pump 10, receiving fluid from reservoir 12 through conduit 14, and delivering fluid under pressure through output port 16. The variable displacement pump 10 is equipped with a compensator 20 for controlling the stroke or the displacement and thus the output thereof.

The variable dislacement pump 10 may supply fluid to various work circuits including a priority circuit such as the steering circuit generally designated 22. Fluid is delivered to the steering circuit 22 via conduits 24 and 26. A first one-way check valve 30 allows the passage of fluid from the variable displacement pump 10 to the steering circuit 22 and prevents flow in the opposite direction. The use of this one-way check valve is optional and is not mandatory for the correct operation of the device hereinafter disclosed.

Fluid under pressure may also be delivered to a secondary work circuit, generally designated 32, after this fluid passes through a flow compensating priority valve generally 34.

Flow compensating priority valve 34 consists of several components including an orifice 36*a*, a priority spool valve 40 and a relief valve 44. Alternatively orifice 36*a* may be remote from the valve body but in line 54 as shown by orifice 36*b* in alternative FIG. 1*b*. Fluid may pass through the priority spool valve 40 when opened from conduit 24 via conduit 46 to deliver fluid to the secondary work circuit 32.

Conduit 50 joins conduit 46 at tee 42 for subsequent delivery to the secondary circuit 32. A steering signal line 54 is pressurized when the hand pump 60 is operated. The steering signal line branch 78 also communicates the steering signal to the compensator 20 of the variable displacement pump 10. The relief valve 44 may allow passage of fluid from conduit 54 to conduit 50 when urged open through pressure transmitted through relief valve pilot line 64 sufficient to overcome the pressure of relief valve spring 66.

The secondary work circuit 32 may consist of a motor and control valve as shown. The motor in this case is a double acting cylinder 70 connected to a control valve spool 72 of the closed center type which may be manually operated to allow displacement of the cylinder piston 74 in a conventional manner. The control valve spool 72 allows fluid to pass from the conduit 46 to either side of the cylinder 70. Fluid being displaced from the cylinder 70 will be directed by the control valve spool 72 to the reservoir 12*a* via conduit 76. Conduits 80 and 82 allow fluid communication between the cylinder 70 and the control valve spool 72. Secondary circuit signal line 84 having a one-way valve 68 allows communication of pressure from the displaced control valve spool to the compensator 20 of the variable displacement pump 10. A check valve 58 prevents the secondary circuit signal from affecting the pressure in steering signal line 54.

The steering circuit 22 is generally conventional. It may be of the type incorporating a hand pump 60. A steering cylinder 86 is provided with fluid under pressure as directed to it in an appropriate conventional manner from a steering control valve 90. A steering wheel 142 may be used as an input device to direct the displacement of the steering control valve 90 and the attendent displacement of the steering cylinder piston 92 in the steering cylinder 86. This of course is associated with appropriate hardware to provide steering of the vehicle.

FIG. 2, as previously disclosed, is identical to FIG. 1 in operating principle, however, details of the flow compensating priority valve are set forth in a cutaway presentation.

Already set forth are the variable displacement pump 10, its compensator 20, the steering circuit generally 22, the first one way check valve 30, the secondary work circuit generally 32, the flow compensating priority valve generally 34, as well as fluid delivery conduits 24, 26, 46, and pressure sensing pilot lines 84, 54, and 78.

Several details are somewhat different in FIG. 2 and present alternative embodiments, however, the operation of the instant invention yields identical results in each case. For instance, the secondary work circuit generally designated 32 in FIG. 2 is comprised of three individual work circuit modules 32*a*, *b*, and *c* having individual one-way valves 68*a*, 68*b*, and 68*c*, which may represent three secondary work circuits on a vehicle such as a farm tractor. Flow compensating priority valve generally designated 34 is shown as a single valve block in FIG. 2 thus conduits 50, 46, 24, of FIG. 1 are shown as passages with new reference characters in FIG. 2. The orifice 36 of FIG. 1 is at the innermost end of steering signal line 54.

Details of the flow compensating priority valve 34 are clearly shown in FIG. 2. The valve body 94 contains, in passage 96, the priority spool 92. Discharge passage 104 may receive fluid flow from passage 95 when the priority spool 92 is displaced to the left in passage 96 sufficiently far to uncover annular orifice 106. Discharge passage 104 is associated with conduit 46 to allow fluid flow to the secondary work circuit 32. Relief valve passage 110 may allow fluid communication between passage 96 and passage 100 upon opening of the relief valve 44. Passage 112 allows leakage past the relief valve to return to reservoir 12*b*.

The priority spool 92 is urged to a position to block annular orifice 106 by a priority spool spring 114.

The relief valve 44 is responsive to fluid pressure in relief valve passage 110 and relief valve spool 124 will be urged against relief valve spring 126 due to this force. Stop pin 130 is provided to limit the displaced travel of the relief valve spool 124 to prevent coil contact in the spring. The relief valve 44 may be adjusted by varying the compressed length of the spring 126 in the bore 132 through the adjustment of adjustment screw 138.

Passage 140 is not functional but is the result of machining the valve body 94 for passage 100.

FIG. 2 also shows a metered line 134 from the signal lines 84 and 78 to the reservoir 12*c*.

MODE OF OPERATION

The following example of the operating characteristics of the load sensitive flow compensating priority system of this invention sets forth the basic operation of the device. FIG. 2 is utilized in this explanation.

The variable displacement pump 10 will produce higher output pressure at its output port 16 than the signal it receives at the compensator 20 up to a maximum pressure of, for instance, 2500 psi. Assume about 250 psi output pressure more than signal, but when the variable displacement pump is at maximum pressure the input signal will be equal to this value. The priority spool spring 114, augmented by pressure in steering signal line 54, is set to provide a total pressure drop of less than the 250 psi pressure differential between the variable displacement pump output and the compensator signal input. The relief valve 44 is set to open at something less than the output potential of the variable displacement pump for instance in this example it is set for 2200 psi.

In operation, when pressure is required in the secondary circuit 32 fluid from the variable displacement pump will pass through conduit 24, displace the priority spool 92, through discharge passage 104, and to the appropriate work circuit 32 via conduit 46. The priority spool 92 is forced inwardly compressing priority spool spring 114 permitting fluid to pass directly into discharge passage 104.

During low pressure steering a signal will enter passage 96 through steering signal line 54 forcing the priority spool 92 to close over annular surface 106 blocking flow to the secondary circuit. If the secondary circuit requires higher pressure than does the steering circuit the higher variable displacement pump pressure will overcome the steering signal in line 54, will open initiating flow through the priority spool 92 and allow passing of fluid directly to discharge passage 104 and on to the secondary circuit 32.

When steering pressure is higher than the pressure required by the secondary circuit the variable displacement pump pressure may still overcome the steering signal (line 54), since priority spool spring 114 is not strong enough to overcome the 250 psi differential between the steering signal and the variable displacement pump output. The priority valve will monitor the pressure and if flow to the secondary circuit attempts to reduce system pressure below that required by steering, the combined efforts of the steering signal in line 54 and the priority valve spring will result in the priority valve spring partially closing the priority valve, restricting fluid flow to the secondary circuit.

When the steering is turned as far as possible against a stop (not shown) and held there, the system pressure will go up to the maximum pressure (2500 psi in this example). The steering signal line 54 pressure will also be at 2500 psi. System pressure cannot open the priority spool 92 as it would during normal steering explained above. It would be impossible to operate the secondary circuit under these conditions if some means were not provided to open the priority valve. The relief valve 44 serves this purpose.

When the steering pressure reaches a predetermined value the relief valve 44 will open permitting fluid to flow through the relief valve passage 110 and on to the secondary circuit 32 via passage 100 and discharge passage 104. The pressure drop through orifice 36 resulting from this flow causes the priority spool 92 to be displaced past annular orifice 106 allowing flow to the discharge passage 104. If flow to the secondary circuit causes system pressure to drop below the relief valve setting the relief valve 44 will close stopping flow causing the priority spool to close and reestablish system pressure.

In practice, the relief valve 44 monitors pressure while the priority spool restricts flow so that the system pressure is maintained. The actual pressure setting of the relief valve is not critical. The minimum allowable setting is limited by the fact that the total pressure settings of the priority spool spring 114 and the relief valve setting should be greater than the maximum pressure required for actual steering in the priority circuit.

The uniqueness of the relief valve 44 is that it reads the pressure behind the priority spool and relieves this pressure to the secondary work circuit through passage 100 but does not sense the pressure in the secondary work circuit and is uneffected by it. Most relief valves discharge to tank wasting high pressure flow, energy, and generating heat. A conventional relief valve could be made to discharge into the secondary circuit, but its setting would be affected by the pressure in the secondary circuit which would be unacceptable for this application.

Note that passage 112 does go to reservoir **12*b*, but this is just to relieve leakage into the spring chamber bore 132** of the relief valve.

Also, relief valve feeding orifices in prior art devices would have to be kept small to reduce losses of high pressure flow. The relief valve used herein wastes very little energy as a maximum pressure drop across it is 50 psi (for example) at a low flow rate.

The most important advantage in discharging the relief valve to the secondary work circuit, in addition to conserving power, is that this design eliminates kickback and recoil in the steering hand pump. By discharging the relief valve 44 and the flow through the orifice 36 to the secondary circuit there will not be flow through these components if the secondary work circuit does not require flow. If a valve in the secondary work circuit is suddenly opened the priority spool valve will open quickly enough. If, the relief valve 44 discharged to tank, flow through this valve would cause the priority spool valve to open even though no flow was required for the secondary circuit. If a valve in the secondary work circuit 32 were then opened the priority spool valve 92 would have to close in order to properly monitor flow and pressure. The passage 96 behind the priority spool 92 would have to be refilled with fluid displaced by the spool and this fluid can be replaced only by flow through the orifice 36. To conserve energy the orifice would have to be small and the priority valve spool 92 would not be able to close fast enough to prevent a drop in system pressure. If the vehicle operator was holding the steering against its stop, the system would be at maximum pressure. If the valve in the secondary work circuit were opened to a high flow, low pressure requirement, the priority spool would be unable to close fast enough to prevent a significant drop in system pressure. If the supply of pressure to the steering hand pump 60 becomes less than the pressure in the hand pump the hand pump will motor backwards causing the operator to feel objectionable kickback at the steering wheel 142.

Scrutiny of the circuit operation would reveal that if the secondary circuit were opened while the steering cylinder was dead headed — relief valve open — there would be a pressure drop in the steering circuit causing the relief valve to close which in turn would cause the priority valve to close. In order to close the priority valve, the hydraulic fluid behind it must be replaced. The delay in closing results in a momentary pressure drop in the steering circuit causing the hand pump to motor backwards — i.e. kickback.

The priority dependent system, in the example above — the steering system, may alternatively be a hydraulic brake system, a hitch control hydraulic system or other typical priority necessitating systems. Also the system described above could be used for other types of vehicles and could even be applicable to certain stationary hydraulic systems and installations. Thus, it is apparent that there has been provided in accordance with the invention a flow responsive or load sensitive hydraulic system that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a flow compensated hydraulic system having a variable displacement pump, a priority dependent work circuit, a secondary work circuit and a flow compensating priority valve including a valve body having a plurality of bores, including a first passage and a discharge passage communicating with said first passage therein, a priority valve spool carried in the first passage of said valve body, a priority spool spring urging said priority valve spool to an undisplaced position of repose, the improvement comprising:

a relief valve responsive to pressure in said first passage allowing fluid to flow from said first passage via said discharge passage to said secondary work circuit, said relief valve will remain open and said priority valve spool will be closed when said secondary work circuit does not require fluid flow.

2. In a flow compensated hydraulic system, having a variable displacement pump, a priority dependent work circuit and a secondary work circuit, a flow compensating priority valve comprising:

a valve body having a plurality of bores including a first passage and a discharge passage therein;

a priority valve spool carried in the first passage of said valve body;

a priority spool spring urging said priority valve spool to an undisplaced position of repose;

a flow metering orifice integrally formed in said first passage of said valve body;

a relief valve responsive to a pressure in said first passage allowing fluid to flow from said first passage via said discharge passage to said secondary work circuit.

3. The invention in accordance with claim 2 wherein said relief valve will open causing said priority spool to open responsive to pressure in said first passage allowing fluid, supplied by said variable displacement pump, to flow to said secondary work circuit via said discharge passage.

* * * * *